US007739892B2

(12) United States Patent
Yamakawa et al.

(10) Patent No.: US 7,739,892 B2
(45) Date of Patent: Jun. 22, 2010

(54) METHOD OF MANUFACTURING SEAMLESS PIPES

(75) Inventors: Tomio Yamakawa, Kawanishi (JP); Kazuhiro Shimoda, Nishinomiya (JP)

(73) Assignee: Sumitomo Metal Industries, Ltd., Osaka (JP)

( * ) Notice: Subject to any disclaimer, the term of this patent is extended or adjusted under 35 U.S.C. 154(b) by 0 days.

(21) Appl. No.: 12/453,568

(22) Filed: May 15, 2009

(65) Prior Publication Data

US 2009/0301155 A1 Dec. 10, 2009

Related U.S. Application Data

(63) Continuation of application No. PCT/JP2007/072377, filed on Nov. 19, 2007.

(30) Foreign Application Priority Data

Nov. 20, 2006 (JP) ..... 2006-312363

(51) Int. Cl.
*B21B 19/04* (2006.01)

(52) U.S. Cl. ..... 72/97; 72/209; 72/365.2

(58) Field of Classification Search ..... 72/10.7, 72/96, 97, 100, 208, 209, 365.2, 366.2, 370.01, 72/370.06

See application file for complete search history.

(56) References Cited

U.S. PATENT DOCUMENTS 4,470,282 A * 9/1984 Hayashi ..... 72/97
6,988,387 B2 * 1/2006 Nakaike et al. ..... 72/97
7,100,410 B2 * 9/2006 Yamakawa et al. ..... 72/97
7,146,836 B2 * 12/2006 Hayashi ..... 72/97

FOREIGN PATENT DOCUMENTS

| | | | |
|---|---|---|---|
| JP | 4-182008 | * | 6/1992 |
| JP | 5-261408 | * | 10/1993 |
| JP | 6-218406 | * | 8/1994 |
| JP | 9-300006 | * | 11/1997 |
| JP | 10-005820 | | 1/1998 |
| JP | 2000-334506 | * | 12/2000 |
| JP | 2000-334507 | * | 12/2000 |
| JP | 2001-162306 | | 6/2001 |
| JP | 2001-162307 | | 6/2001 |

* cited by examiner

*Primary Examiner*—Edward Tolan
(74) *Attorney, Agent, or Firm*—Clark & Brody

(57) ABSTRACT

Seamless pipes excellent in quality features with high productivity is made by a by carrying out piercing-rolling using a piercer provided with a pair of inclined rolls. The piercing-rolling is carried out under conditions such that the plug tip draft (TDFT) or the root of the product of the plug tip draft (TDFT) are controlled along with the number of billet revolutions (N), namely $(TDFT \times N)^{0.5}$. In addition, positions of the inclined rolls are controlled in connection with the gorge draft (GDFT) indicating the ratio of the roll gap (Rg) which is minimal in the gorge section between the inclined rolls to the billet outside diameter (Bd). The piercing-rolling is carried out using a plug having a particular shape.

4 Claims, 5 Drawing Sheets

METHOD OF MANUFACTURING SEAMLESS PIPES

This application is a continuation of International Patent Application No. PCT/JP20071072377, filed Nov. 19, 2007. This PCT application was not in English as published under POT Article 21(2).

TECHNICAL FIELD

The present invention relates to a method of manufacturing seamless pipes with a reduced rate of occurrence of raw pipe inner surface defects or flaws, with reduced wall thickness irregularities, without causing such operational troubles as rolling interruptions, and at high piercing efficiency levels.

BACKGROUND ART

Among various technologies known in the art for the manufacture of seamless steel pipes, the most efficient methods suited for mass production are those manufacturing methods which are based on a rolling technique (the so-called Mannesmann process) comprising piercing billets using a pair of inclined rolls and a piercing plug.

In piercing by the rolling technique, a heated billet is transferred to a piercing machine (piercer), pushed by a pusher and gripped by a pair of inclined rolls. Thereafter, the billet advances while the rolls rotate it. On that occasion, a rotary forging effect (Mannesmann effect) is exerted on the central portion of the billet during the period until the billet arrives at the tip of the piercing plug disposed along the pass line between the rolls and, as a result, that central portion becomes fragile. Then, the billet undergoes piercing-rolling by the pair of inclined rolls and the plug to form a hollow raw pipe (hereinafter also referred to as "raw pipe" for short). The hollow raw pipe is further processed in the subsequent steps, including elongation rolling, to give a seamless pipe having a predetermined size.

The piercing-rolling mentioned above is also applied to billets made of, for example, a continuously casting material having center segregations and/or porosity or of a stainless steel species poor in hot deformability. On that occasion, the rotary forging effect and additional shear deformation cause formation of leaf-like, fin-like or lap-like flaws or defects on the inner surface of the hollow raw pipe (such defects are collectively referred to as "inner surface defects"). For preventing this, the plug tip draft is generally reduced to thereby suppress the rotary forging effect as far as possible and prevent the formation of such inner surface defects. However, the reduction in plug tip draft tends to allow the occurrence of misrolling such as a gripping failure.

The plug tip draft is defined by the following formula:

$$(Bd-d1)/Bd, \text{ namely } 1-(d1/Bd)$$

Therefore, to reduce the plug tip draft means that when the billet diameter (Bd) is constant, d1 (gap between the rolls at the plug tip position) is increased or that the plug is shifted forward to the billet side to shift the tip thereof in the direction toward the smaller roll diameter side (cf. FIG. 1).

Patent Documents 1 and 2 describe methods of manufacturing seamless pipes one feature of which is to employ a plug tip draft of not lower than 95% or not lower than 97%. However, while these documents define the plug tip draft as "gap between the rolls at the plug tip position/billet diameter", the above-cited "not lower than 95%" and "not lower than 97%" should properly be described as "not lower than 0.95" and "not lower than 0.97", respectively. And, these plug tip draft ranges correspond to "not higher than 0.05" and "not higher than 0.03", respectively, according to the original definition given above.

[Patent Document 1] Japan Patent Unexamined Publication No. 2001-162307 (Application No. H11-346513)

[Patent Document 2] Japan Patent Unexamined Publication No. 2001-162306 (Application No. H11-346514)

Another difficulty arising from such reduction in plug tip draft consists in a decrease in piercing efficiency. The piercing efficiency is the percentage of the longitudinal advancement velocity of the raw pipe to the longitudinal direction component of the roll gorge peripheral velocity and is defined as follows:

$$\eta=(V_H/V_R \sin\theta)\times 100(\%)$$

where $\eta$ is the piercing efficiency (%), $V_H$ is the longitudinal velocity of the raw pipe (m/s) and $V_R$ is the roll gorge peripheral velocity (m/s).

FIG. 4 shows the results of tests carried out for piercing efficiency investigations using plugs of the same shape under the conditions shown in Table 1. As shown, the piercing efficiency decreases with the increase in plug tip draft and, in particular, the decrease in piercing efficiency is remarkable when the plug tip draft is 0.04 or lower.

[Table 1]

TABLE 1

| | |
|---|---|
| Billet material and size | S45C, SUS304, diameter: 70 mm |
| Hollow raw pipe size | diameter: 75 mm, wall thickness: 8 to 9 mm |
| Roll gorge diameter | 410 mm |
| Toe angle $\gamma$ | 15° |
| Feed angle $\beta$ | 10° |
| Plug tip draft TDFT | 0 to 0.05 |
| Maximum plug diameter | 58 mm |
| Distance from plug tip to maximum diameter site | 115 mm |

A reduction in piercing efficiency means a decrease in the longitudinal velocity of the raw pipe (above-mentioned $V_H$) or, in other words, a decrease in the longitudinal velocity of the billet and means that the time during which the rotary forging effect is exercised on the billet is prolonged (the number of times of roll forging at the predetermined position of the billet is increased). Thus, with steel species having defects at the central portion, for example continuously casting materials, an excessive rotary forging effect even if the plug tip draft is set at a low level causes inner surface defects.

Furthermore, as a result of a decrease in piercing efficiency, the metal flow of the rolling target material is restrained in the axial direction and is facilitated in the circumferential direction. Then, the additional shear deformation in the circumferential direction increases, and the defects produced in front of the plug are further intensified by that shear deformation and, as a result, they remain on the raw pipe as large-size inner surface defects. In addition, the time required for piercing is prolonged by the decrease in piercing efficiency, so that a further problem arises, namely the thermal load on the plug increases and the life of the plug is shortened.

The methods described in the above-cited Patent Documents 1 and 2 both consist in combining a reduced roll circumferential velocity with pushing in by means of a pusher. According to these methods, piercing is carried out at a low plug tip draft even in the piercing of the middle portion of the billet, so that cracking due to the rotary forging effect in front of the plug can indeed be suppressed. However, under certain conditions of setting of the rolls and according to the shape of the plug, the slip in piercing the middle and subsequent portions of the billet increases and, as a result, the piercing efficiency may be decreased thereby, although the problem of gripping failure can be solved.

If the piercing efficiency in piercing the middle and subsequent portions of the billet is decreased, as mentioned above, the velocity, in the direction of rolling, of the entry side billet is decreased even in the steady rolling region, the number of billet revolutions (number of times of contacting between the roll pair and the rolling target material during the period from gripping of the billet by the rolls to the arrival of the billet at the plug tip) increases. Therefore, the number of times of the billet experiencing the rotary forging effect increases and, even if the plug tip draft is lower, cracks will be caused in the vicinity of the billet center by the excessive rotary forging effect and thus remain as inner surface defects in the raw pipe.

DISCLOSURE OF INVENTION

Problems to be Solved

It is an object of the present invention to provide a technology of manufacturing seamless pipes excellent in quality with high productivity. More specifically, it is an object of the invention to provide a method of manufacturing seamless pipes without causing a reduction in piercing efficiency all over the total length of the piercing target material and without causing stoppage of rolling or like misrolling events while preventing the development of raw pipe inner surface defects and reducing the wall thickness irregularities.

Means for Solving the Problems

The gist of the invention consists in any of the methods of manufacturing seamless pipes as defined below under (1)-(3).

(1) A method of manufacturing seamless pipes by carrying out piercing-rolling using a piercer provided with a pusher disposed on the entry side along the pass line, a plug disposed on the exit side along the pass line and a pair of inclined rolls disposed so as to face each other across the plug which method is characterized in that it has the following features (a) to (d):

Feature (a): That the piercing-rolling is carried out under conditions such that the plug tip draft (TDFT) is not higher than 0.04 and/or the root of the product of the plug tip draft (TDFT) and the number of billet revolutions (N), namely $(TDFT \times N)^{0.5}$, is not greater than 0.4;

Feature (b): That the positions of the inclined rolls are selected so that the gorge draft (GDFT) indicating the ratio of the roll gap (Rg) which is minimal in the gorge section between the inclined rolls to the billet outside diameter (Bd), namely Rg/Bd, may satisfy the relations defined by the formula (1) given below;

Feature (c): That the piercing-rolling is carried out using a plug having a shape satisfying the relations defined by the formula (2) given below;

Feature (d): That the pusher pushes the billet at least in the unsteady region of the piercing-rolling.

$$-0.01053 \times EL + 0.8768 \leqq GDFT \leqq -0.01765 \times EL + 0.9717 \quad (1)$$

$$-0.95 \times (TDFT \times N)^{0.5} + 1.4 \leqq L2/d2 \leqq -1.4 \times (TDFT \times N)^{0.5} + 3.15 \quad (2)$$

In the above formulas, $$TDFT = 1 - (d1/Bd)$$

where d1: minimum roll-to-roll distance (mm) at the plug tip position and

Bd: billet outside diameter (mm), $$N = (Ld \times EL)/(0.5 \times n \times Bd \times \tan \beta)$$

where Ld: projected contact length (mm) from the billet gripped point to the plug tip, EL: piercing ratio or elongation, namely [hollow raw pipe length]/[billet length], β: roll feed angle, L2: rolling section length (mm) of the plug, and d2: outside diameter (mm) of the plug at the boundary position between the rolling section and reeling section thereof.

(2) A method of manufacturing seamless pipes as defined above under (1), wherein, in the feature (d), the billet is pushed by the pusher in the unsteady region and steady region of piercing-rolling.

(3) A method of manufacturing seamless pipes as defined above under (1) or (2), wherein the piercing-rolling is carried out while the longitudinal advancement velocity of the pusher is set at a level not lower than the velocity of the entry side billet in the direction of advancement thereof in the steady state brought about without using the pusher.

EFFECTS OF THE INVENTION

According to the method of the invention, hollow raw pipes with reduced inner surface defects and reduced wall thickness irregularities can be manufactured with high efficiency without causing such operational troubles as rolling interruptions.

BEST MODES FOR CARRYING OUT THE INVENTION

In the following, the features of the method of the invention will be described one by one referring to the drawings.

FIG. 1 is a schematic plan view illustrating an example of the apparatus for carrying out the method of the invention, and FIG. 2 is a side view illustrating the piercing site in the apparatus. In both figures, a part is shown in section.

A piercer 10 is provided with a pair of cone-shaped inclined rolls (hereinafter referred to merely as "rolls") 1, a plug 2, a core bar 3, a pusher 4 and an HMD (hot metal detector) 51. The pair of rolls 1 are disposed at a toe angle γ and a feed angle β relative to the pass line X-X.

The plug 2 is attached to one end of the core bar 3 and is disposed on the pass line X-X between the rolls. The plug to be used in carrying out the method of the invention has a special shape, as described later herein.

The pusher 4 is disposed on the pass line X-X. In the example shown, the pusher consists of a hydraulic cylinder body 41, a cylinder shaft 42, a connecting member 43 and a billet pushing rod 44, although the pusher type is not limited thereto. In sum, the only requirement is that the pusher can carry out its function in forcedly pushing the billet 20 toward the piercer by a predetermined force. The HMD 51 is a detecting device and detects the passage or no passage of the tip of a pierced hollow raw pipe between the rolls.

1. Re: Feature (a)

The plug tip draft (TDFT) is set at 0.04 or below for the purpose of inhibiting the formation of inner surface defects on the raw pipe by lowering the pressure. The root of the product of the gorge draft (GDFT) and the number of billet revolutions (N), namely $(GDFT \times N)^{0.5}$, is set at 0.4 or below for the purpose of inhibiting the formation of inner surface defects and, in addition, stabilizing the piercing-rolling process and thereby preventing rolling interruptions and other troubles and reducing the raw pipe wall thickness irregularities. When the number of billet revolutions (N) is too great, the degree of wall thickness processing resulting from processing by the rolls and plug per half a rotation of the rolling target material becomes high and the slip becomes great, causing a decrease in piercing efficiency, although the rotary forging effect and additional shear deformation can be suppressed. Further, the piercing-rolling process becomes unstable and the raw pipe wall thickness irregularities may be exaggerated in certain instances. Therefore, the TDFT should be not higher than 0.04 and/or the root $(GDFT \times N)^{0.5}$ should be not greater than 0.4.

One of the objects of the invention is to reduce the raw pipe wall thickness irregularities. Generally, when the plug tip draft is or lower, the piercing efficiency decreases and the whirling of the rolling target material during piercing becomes intensified, resulting in increased wall thickness irregularities. According to the method of the invention that comprises increasing the propulsive force from the rolls and decreasing the plug's drag, however, the piercing-rolling process is carried out stably and the wall thickness irregularities are reduced.

2. Re: Feature (b)

FIG. 5 is a representation of the results of an investigation concerning the relationship between the amount of travel from the grip of the billet by the rolls and the velocity of advancement. As shown, the billet advancement velocity abruptly lowers after the billet comes into contact with and is gripped by the rolls. The advancement velocity becomes minimal at the position (the point LE1 on the abscissa) of beginning of piercing following contacting of the billet front with the plug. Thereafter, the billet is gripped stably (namely the billet advances without slipping) and, as the piercing proceeds, the billet advancement velocity gradually increases and arrives at an almost constant level, namely a steady state.

As shown in FIG. 5, the billet advancement velocity is lower in the unsteady state (from LE1 to LE2 in the figure) than after arrival at the steady state (LE2 and thereafter). On the other hand, the rotational speed of the rolls is constant during the piercing operation. Therefore, the rotary forging effect per unit amount of travel of the billet in the unsteady region becomes greater than that in the steady region. As a result, inner surface defects are produced in many places at the front-end portion of the hollow raw pipe.

The "steady state" refers to the period from the time point of passage of the front end of the pierced and rolled billet (namely the front end of the hollow raw pipe) through the rear end of the rolls to the time point of contacting of the billet rear end with the rolls. The "unsteady state" refers to the period from the time point of the billet front end gripped by the rolls, after advancement, coming into contact with the plug to the time point of the billet reaching the above-mentioned steady state.

For preventing the formation of inner surface defects on the hollow raw pipe, it is necessary to increase the billet advancement velocity in the unsteady state. This is because the above-mentioned rotary forging effect per unit amount of travel of the billet is then reduced. One means therefor is the use of a pusher. Since it is desirable to increase the billet advancement velocity in the steady state as well, it is recommended that the pressure application by means of the pusher be made continuously.

When the billet outside diameter (Bd) is constant, a small gorge draft (GDFT, namely Rg/Bd) means a small roll gap (Rg). In that case, the ellipticity of the cross-sectional shape of the billet during piercing increases and the angle of grip by the rolls in the direction of rotation of the rolling target material increases. This increase in grip angle causes slipping of the billet. On the other hand, when the gorge draft (GDFT, namely Rg/Bd) is excessively high, the roll gap (Rg) becomes large and, therefore, the area of contact between the rolls and billet decreases and the propulsive force in the direction of rolling as applied to the rolling target material by the rolls decreases and, in this case, too, slipping may occur. In particular, within the range of low plug tip drafts, the influence of the gorge draft (GDFT) on the slipping of the rolling target material is more significant as compared with the case where the plug tip draft is relatively high. Therefore, for the gorge draft (GDFT), there is an appropriate range for inhibiting the slip, and it is necessary that the arrangements for the mill be made within that range.

The piercing ratio (EL, namely hollow raw pipe length/billet length) also influences the slip. For increasing the piercing ratio, it is necessary to reduce the wall thickness of the hollow raw pipe and, for that purpose, the plug outside diameter must be increased and also the whole plug must be made larger, so that the plug resistance increases. Therefore, when the piercing ratio of the piercing-rolling increases at the same set value of the gorge draft (GDFT), slipping tends to occur with ease.

FIG. 6 is a representation of the results of piercing tests performed using S45C billets with an outside diameter of 70 mm at an feed angle of 10° and a toe angle of 20° while varying the piercing ratio (EL) and gorge draft (GDFT). In the piercing-rolling, the billet was pushed by a pusher to cause the billet to be gripped by the rolls and the pushing was continued until arrival at the steady piercing-rolling state. After stopping the pusher, an examination was made as to the occurrence of non-occurrence of slipping.

In FIG. 6, the marks ○ indicate that stable piercing-rolling could be performed without misrolling due to slipping. The marks ● indicate that slipping occurred frequently during piercing-rolling, resulting in misrolling. In cases where the billet stopped advancing during piercing-rolling or where the billet stopped advancing during piercing of the billet rear end (the so-called tailing out failure), it was judged that slipping had occurred.

As is evident from FIG. 6, the region in which stable piercing-rolling can be performed without the occurrence of slipping is the region surrounded by the two straight lines A and B. The straight lines A and B are respectively represented by the following equations:

$$\text{Straight line A: } GDFT = -0.01053 \times EL + 0.8768;$$

$$\text{Straight line B: } GDFT = -0.01765 \times EL + 0.9717.$$

Therefore an appropriate gorge draft (GDFT) value is within the range represented by the following formula (1):

$$-0.01053 \times EL + 0.8768 \leqq GDFT \leqq -0.01765 \times EL + 0.9717 \quad (1)$$

3. Re: Feature (c)

Piercing tests were performed under the conditions specified in Table 2 while the L2 and d2 of the plug were varied. As shown in FIG. 3, L2 is the length (mm) of the rolling section of the plug, and d2 is the outside diameter (mm) of the plug at the boundary position between the rolling section 31 and reeling section 32 of the plug. The rolling section is the section for processing for an extent of wall thickness processing of not smaller than 98%, and the reeling section is the section for smoothly finishing the wall thickness of the rolling target material. The flank section 33 is the section where the pipe diameter reduces to the same diameter as the maximum plug diameter or the diameter reduces toward the back.

[Table 2]

TABLE 2

| | |
|---|---|
| Billet material and size | S45C, diameter: 70 mm |
| Hollow raw pipe size | diameter: 75 mm, wall thickness: 8 to 9 mm |
| Roll gorge diameter | 410 mm |
| Toe angle γ | 20° |
| Feed angle β | 8 to 14° |
| Plug tip draft TDFT | 0 to 0.05 |
| L2/d2 | 0.5 to 3.75 |
| $(TDFT \times N)^{0.5}$ | 0 to 0.38 |

The piercing-rolling tests were carried out using a plug having a shape determined by using, as a parameter, the root of the product of the plug tip draft and the number of billet revolutions. The test results are shown in FIG. 7. As already mentioned hereinabove, it is known in the art that when piercing-rolling is carried out in a manner such that the plug tip draft becomes small, the piercing efficiency decreases. It was revealed, however, that, in the piercing-rolling in which the plug tip draft becomes 0.04 or lower, as shown in FIG. 7, there is a correlation also between the ratio L2/d2 and the piercing efficiency. Namely, as the value of L2/d2 increases, the piercing efficiency generally becomes higher and, moreover, the decrease in piercing efficiency due to the decrease in plug tip draft becomes smaller.

As mentioned above, L2 is the length of the rolling section of the plug, and d2 is the plug diameter at the point of termination of the rolling section (the point of start of the reeling section). FIG. 7 shows that when piercing-rolling is performed within an appropriate range of the value of L2/d2, the piercing efficiency can be maintained at a high level.

Then, referring to the results shown in FIG. 7, a large number of tests were performed by further varying the roll setting conditions and the number of billet revolutions (N) calculated from the piercing results, and the results shown in FIG. 8 were obtained. In FIG. 8, the abscissa denotes the value of $(TDFT \times N)^2$, and the ordinate denotes the ratio L2/d2. As mentioned previously, TDFT stands for plug tip draft.

In FIG. 8, the marks ● indicate those cases where plug clogging (billet grip failure), bottom clogging or plug life shortening occurred, the marks x indicate those cases where the piercing efficiency was 70% or lower, the marks Δ indicate those cases where the piercing efficiency was above 70% but lower than 75%, and the marks ○ indicate those cases where the piercing efficiency was 75% or higher and stable piercing could be performed and no raw pipe inner surface defects were found. The region encompassing such marks ○ is surrounded by the straight lines A and B, where the straight lines are respectively represented by the following equations:

$$\text{Straight line A: } L2/d2 = -0.95 \times (TDFT \times N)^{0.5} + 1.4$$

$$\text{Straight line B: } L2/d2 = -1.4 \times (TDFT \times N)^{0.5} + 3.15$$

In view of the foregoing, the region covering the above-mentioned marks ○, namely the region in which the piercing can be preformed stably with a piercing efficiency of not lower than 75%, without formation of raw pipe inner surface defects, is the region represented by the formula (2) given below.

$$-0.95 \times (TDFT \times N)^{0.5} + 1.4 \leqq L2/d2 \leqq -1.4 \times (TDFT \times N)^{0.5} + 3.15 \quad (2)$$

4. Re: Feature (d)

Referring to FIG. 1, the billet 20 is gripped by the rolls 1, upon which the piercing step is started. Until arrival at a steady state in which the gripped billet front end (raw pipe front end) leaves the rolls or, in other words, during in an unsteady state, the billet 20 is propelled by the pusher 4 so that the billet advancement velocity may be not lower than the advancement velocity in a steady state attainable without using the pusher. The billet advancement velocity in the unsteady state is the average velocity value in the unsteady region, and the advancement velocity in the steady state is the average advancement velocity in the steady state of a billet almost identical in outside diameter and steel species to the billet 20.

It is more preferred that the billet be propelled by the pusher so that the thrust loading borne by the plug 2 in the unsteady state may be not lighter than the thrust loading borne by the plug 2 in the steady state in the case of using no pusher. By this, it becomes possible to inhibit the billet 20 from slipping in the unsteady state. Further, since the billet advancement velocity in the unsteady state becomes greater than in the case of using no pusher, the rotary forging effect becomes lessened, so that the formation of hollow raw pipe inner surface defects is inhibited. The thrust loading borne by the plug in the steady state may be measured in advance or calculated based on various conditions such as the roll rotation speed and billet shape.

Further, when the advancement velocity of the billet 20 in the unsteady state is higher than the advancement velocity thereof in the steady state without using the pusher, the rotary forging effect becomes less than the rotary forging effect in the steady state without using the pusher and, as a result, the appearance of inner surface defects becomes more infrequent. The advancement velocity in the steady state without using the pusher may be measured in advance or calculated based on various conditions such as the roll rotation speed and billet shape.

Once the piercing-rolling has arrived at the steady state, namely when the HMD 51 detects that the raw pipe front end has left the rolls, the operation of the pusher is discontinued. After arrival of the piercing-rolling at the steady state, the billet is pierced while advancing at a constant velocity without propulsion by the pusher. However, the propulsion by means of the pusher may be continued even in the steady state. By doing so, it becomes possible to perform the piercing-rolling at a higher advancement velocity than in the case of using no pusher in the steady region, hence the effects of reducing the appearance of inner surface defects and increasing the piercing efficiency can be obtained.

FIG. 9 is a representation of the results obtained by performing the piercing-rolling under the same conditions as in the previous tests the results of which are shown in FIG. 5 except that the propulsion by the pusher in the unsteady state was employed. In FIG. 9, as is evident upon comparison with FIG. 5, the advancement velocity in the unsteady region (region between LE1 and LE2) is found to have increased to a level almost comparable to the velocity in the steady region.

While the piercing method described above is in the main based on the rolling technique using cone-shaped rolls as taken by way of example, the rolls may be barrel-shaped ones. The method of the invention can also be carried out in the manner of inclined rolling piercing using rolling rolls having only a feed angle.

Round billets with a diameter of 70 mm were cut out from the central portion of round 1.0% Cr-0.7% Mo steel ingots with a diameter of 225 mm as obtained by continuous casting were subjected to piercing-rolling under the conditions of a heating temperature of 1200° C., a toe angle of 15° and an feed angle of 100 to manufacture raw pipes with an outside diameter of 75 mm and a wall thickness of 8 mm. The gorge draft (GDFT) and plug shape were selected so that the respective requirements represented by the formulas (1) and (2) might be satisfied, and the plug tip draft was 0.01.

The piercing tests were performed using 100 billets and, for each raw pipe, the condition of occurrence of inner surface defects was observed and the mean wall thickness irregularity percentage (mean value of peripheral direction wall thickness irregularity percentages measured at various sites in the longitudinal direction) and piercing efficiency were calculated.

The measurement results were as follows. There was no inner surface defect formation, the piercing effect was 77-82%, and the mean wall thickness irregularity percentage was not higher than 4%. From these results, it is evident that high quality raw pipes can be manufactured with high efficiency according to the method of the invention. When those conditions which failed to satisfy the setting conditions specified herein were employed, the piercing efficiency was not higher than 60% and some cases resulted in rolling interruptions. In the piercing-rolling according to the prior art methods, the mean wall thickness irregularity percentage is about 6%.

INDUSTRIAL APPLICABILITY

In accordance with the present invention, it is possible to manufacture seamless pipes with reduced wall thickness irregularities while preventing the formation of inner surface defects all over the total length of the raw pipes even from materials poor in deformability, for example continuously cast materials and Cr-containing high alloy steels.

EXPLANATION OF SYMBOLS

Figure 1:
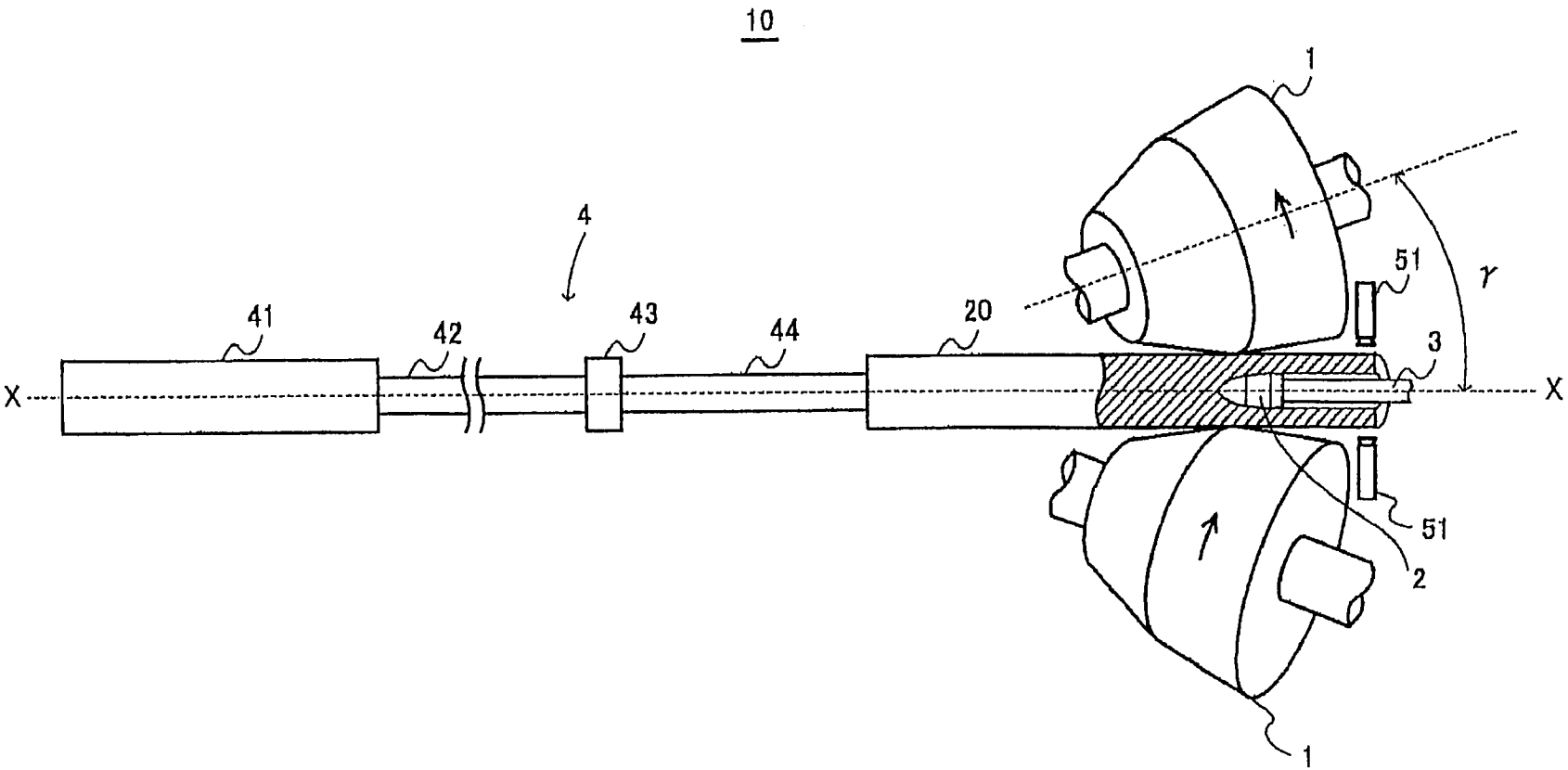
FIG. 1 This is a schematic plan view (partly in section) of a piercing-rolling mill for carrying out the method of the invention.
Figure 2:
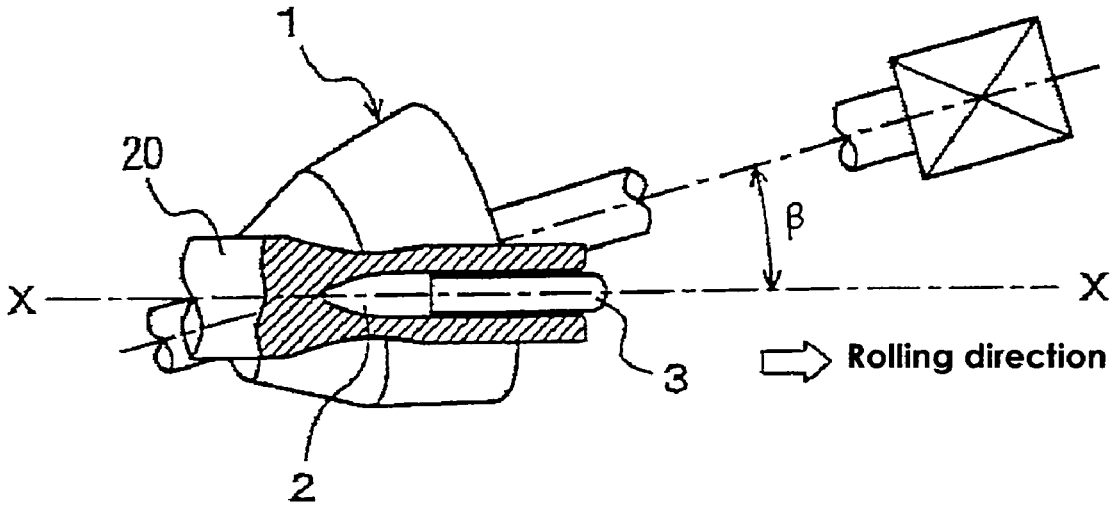
FIG. 2 This is a side view (partly in section) illustrating the piercing section of FIG. 1.
Figure 3:
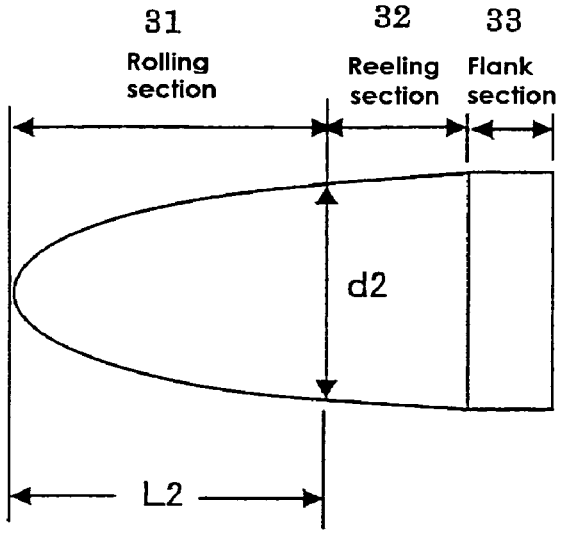
FIG. 3 This is an illustration showing the shape of a plug to be used in carrying out the method of the invention.
Figure 4:
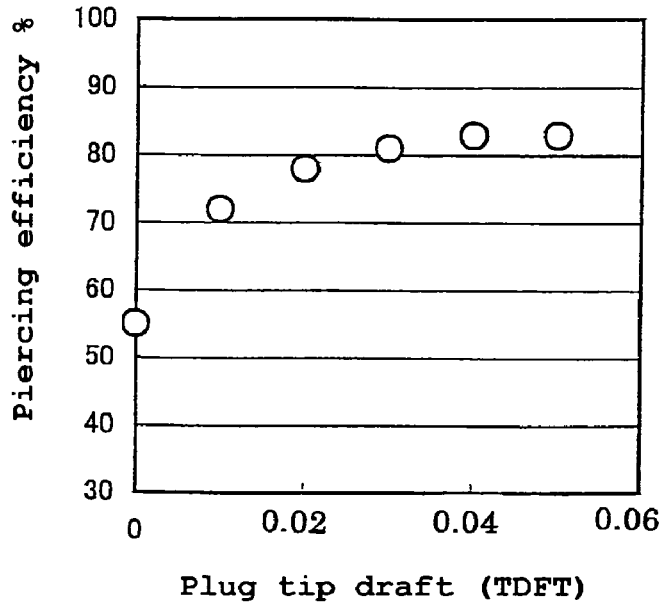
FIG. 4 This is a graphic representation showing the relationship between the plug tip draft (TDFT) and piercing efficiency.
Figure 5:
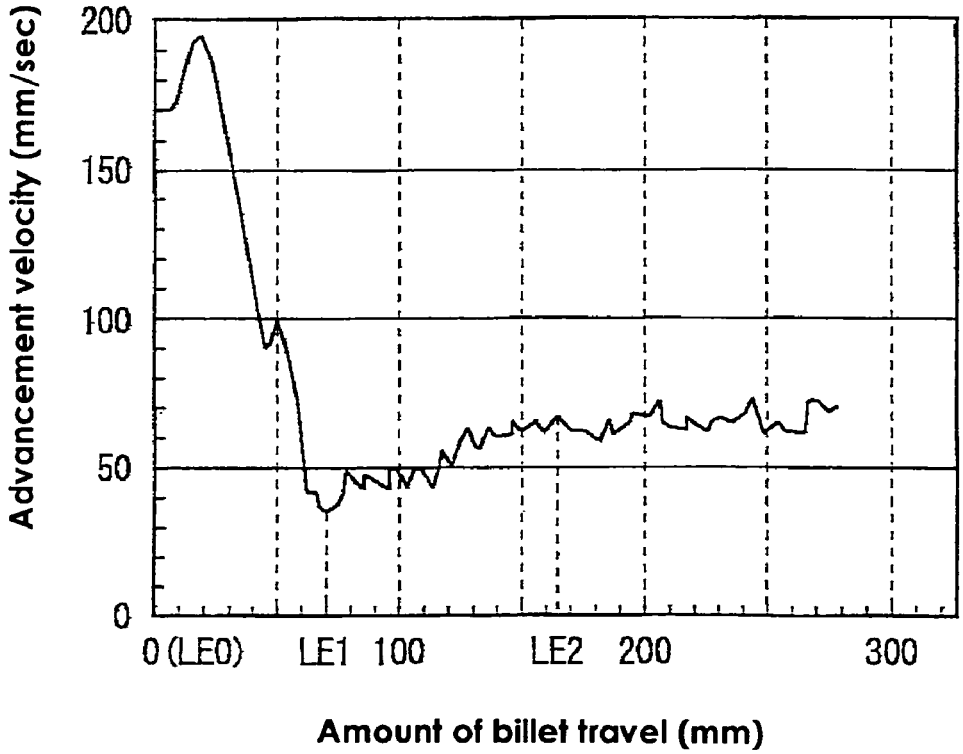
FIG. 5 This is a graphic representation showing the relationship between the amount of billet travel and the advancement velocity when no pusher is used.
Figure 6:
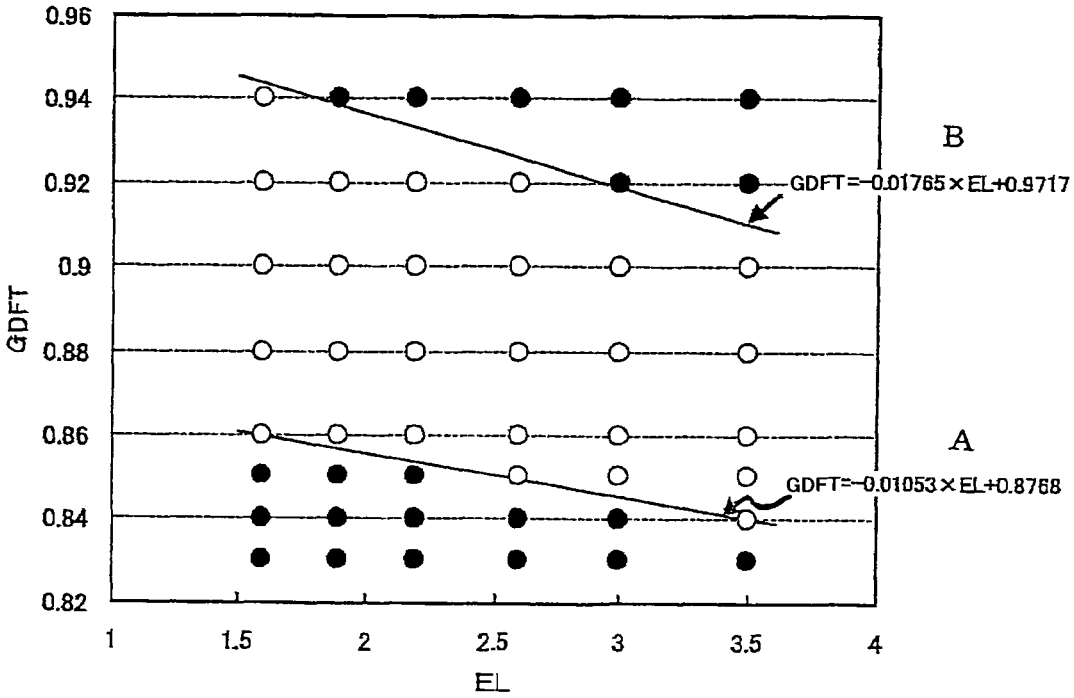
FIG. 6 This is a graphic representation showing the relationship between the piercing ratio (EL) and gorge draft (GDFT).
Figure 7:
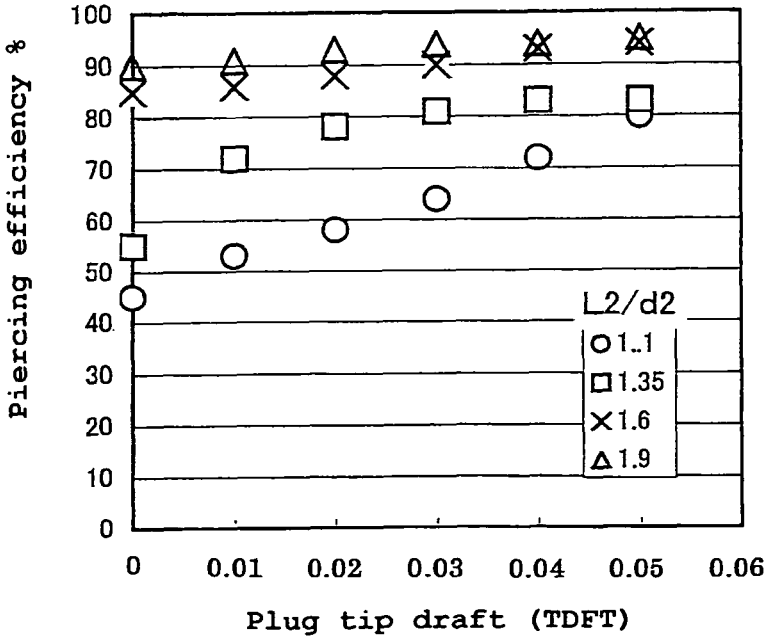
FIG. 7 This is a graphic representation showing the relationship among the plug shape (L2/d2), plug tip draft (TDFT) and piercing efficiency.
Figure 8:
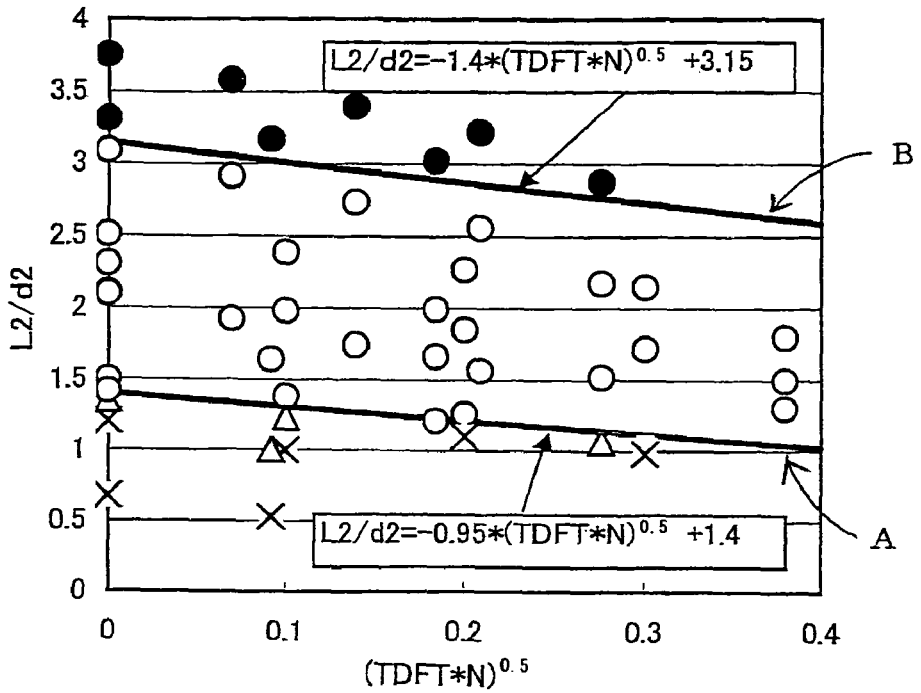
FIG. 8 This is a graphic representation showing the effects of the root of the product of the plug tip draft (TDFT), the number of billet revolutions (N) and the plug shape (L2/d2) on the condition of piercing-rolling.
Figure 9:
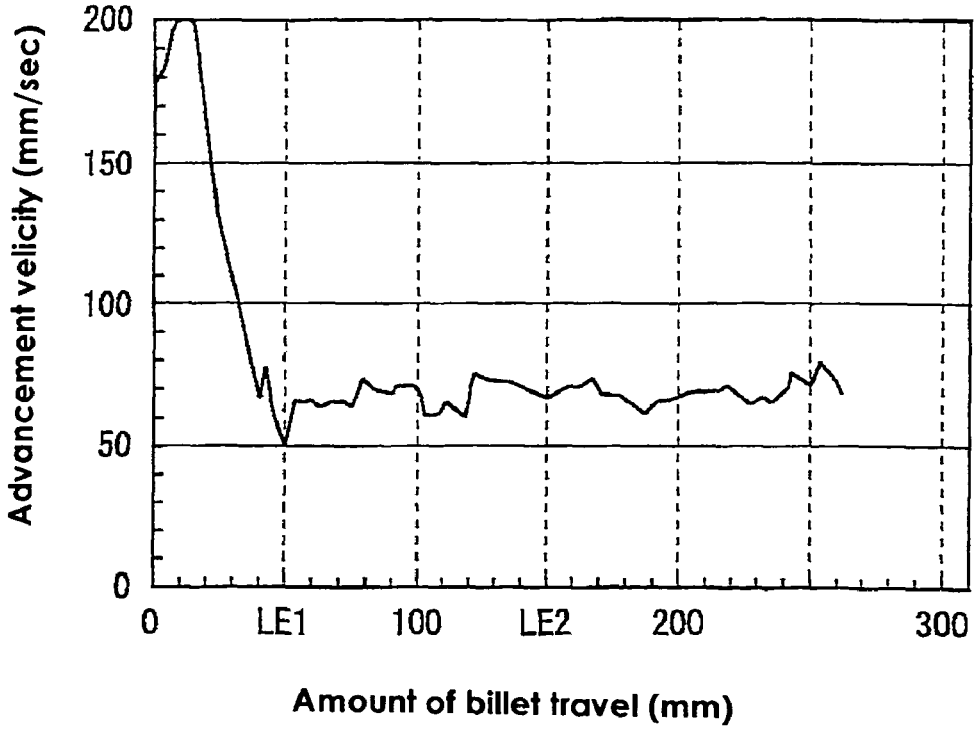
FIG. 9 This is a graphic representation showing the relationship between the amount of billet travel and the advancement velocity when a pusher is used.

1: rolls, 2: plug, 3: core bar, 4: pusher, 20: billet, 51: HMD.

The invention claimed is:

1. A method of manufacturing seamless pipes by carrying out piercing-rolling using a piercer provided with a pusher disposed on the entry side along the pass line, a plug disposed on the exit side along the pass line and a pair of inclined rolls disposed so as to face each other across the plug which method is characterized in that it has the following features (a) to (d):

Feature (a): That the piercing-rolling is carried out under conditions such that the plug tip draft (TDFT) is not higher than 0.04 and/or the root of the product of the plug tip draft (TDFT) and the number of billet revolutions (N), namely $(TDFT \times N)^{0.5}$, is not greater than 0.4;

Feature (b): That the positions of the inclined rolls are selected so that the gorge draft (GDFT) indicating the ratio of the roll gap (Rg) which is minimal in the gorge section between the inclined rolls to the billet outside diameter (Bd), namely Rg/Bd, may satisfy the relations defined by the formula (1) given below;

Feature (c): That the piercing-rolling is carried out using a plug having a shape satisfying the relations defined by the formula (2) given below;

Feature (d): That the pusher pushes the billet at least in the unsteady region of the piercing-rolling:

$$-0.01053 \times EL + 0.8768 \leqq GDFT \leqq -0.01765 \times EL + 0.9717 \quad (1)$$

$$-0.95 \times (TDFT \times N)^{0.5} + 1.4 \leqq L2/d2 \leqq -1.4 \times (TDFT \times N)^{0.5} + 3.15 \quad (2)$$

In the above formulas, $$TDFT = 1 - (d1/Bd)$$

where d1: minimum roll-to-roll distance (mm) at the plug tip position and

Bd: billet outside diameter (mm), $$N = (Ld \times EL)/(0.5 \times \pi \times Bd \times \tan\beta)$$

where Ld: projected contact length (mm) from the billet gripped point to the plug tip, EL: piercing ratio or elongation, namely [hollow raw pipe length]/[billet length], β: roll feed angle, L2: rolling section length (mm) of the plug, and d2: outside diameter (mm) of the plug at the boundary position between the rolling section and reeling section thereof.

2. A method of manufacturing seamless pipes as set forth in claim 1, wherein, in the feature (d), the billet is pushed by the pusher in the unsteady region and steady region of piercing-rolling.

3. A method of manufacturing seamless pipes as set forth in claim 1, wherein the piercing-rolling is carried out while the longitudinal advancement velocity of the pusher is set at a level not lower than the velocity of the entry side billet in the direction of advancement thereof in the steady state brought about without using the pusher.

4. A method of manufacturing seamless pipes as set forth in claim 2, wherein the piercing-rolling is carried out while the longitudinal advancement velocity of the pusher is set at a level not lower than the velocity of the entry side billet in the direction of advancement thereof in the steady state brought about without using the pusher.

* * * * *